US005300862A

United States Patent [19]

Parker et al.

[11] Patent Number: 5,300,862

[45] Date of Patent: Apr. 5, 1994

[54] ROW ACTIVATING METHOD FOR FED CATHODOLUMINESCENT DISPLAY ASSEMBLY

[75] Inventors: Norman W. Parker, Wheaton, Ill.; James E. Jaskie; Robert C. Kane, both of Scottsdale, Ariz.

[73] Assignee: Motorola, Inc., Schaumburg, Ill.

[21] Appl. No.: 897,644

[22] Filed: Jun. 11, 1992

[51] Int. Cl.[5] ..... G09G 3/10

[52] U.S. Cl. ..... 315/169.1; 315/169.3; 315/167; 315/350; 315/351; 345/74; 345/76

[58] Field of Search ..... 315/169.1, 167, 169.3, 315/350, 351, 352; 340/766, 781, 828.79

[56] References Cited

U.S. PATENT DOCUMENTS 2,553,585 5/1951 Hough ..... 315/167

3,889,151 8/1973 Hanak et al. ..... 315/169.1 X 4,459,514 7/1984 Morimoto ..... 340/781 X 4,723,119 2/1988 Morimoto ..... 340/766 X 4,835,447 5/1989 Mizuno et al. ..... 315/169.1

5,153,483 10/1992 Kishino et al. ..... 315/169.1 X

*Primary Examiner*—Robert J. Pascal

*Assistant Examiner*—R. A. Ratliff

*Attorney, Agent, or Firm*—Eugene A. Parsons

[57] ABSTRACT

A display addressing method applied in conjunction with an array of cold cathode field emission micro-emitters employs a row-by-row addressing technique in concert with controlled constant current sources connected simultaneously to each column of the array of emitters to provide a novel addressing scheme which yields an improvement in cathodoluminescent display brightness on the order of a full order of magnitude over that of the prior art.

10 Claims, 4 Drawing Sheets

ROW ACTIVATING METHOD FOR FED CATHODOLUMINESCENT DISPLAY ASSEMBLY

FIELD OF THE INVENTION

The present invention relates generally to cathodoluminescent display devices and more particularly to an addressing method for cathodoluminescent display devices employing cold-cathode field emission electron emitters.

BACKGROUND OF THE INVENTION

Cathodoluminescent display devices are well known in the art and commonly referred to as cathode ray tubes (CRTs). CRTs are commonly employed to provide visual information in systems such as television, radar, computer display, aircraft navigation and instrumentation. CRTs are commonly operated by scanning a very small cross-sectional beam of electrons horizontally and vertically with respect to a layer of cathodoluminescent material (phosphor) which is deposited on the back side of the viewing area of the CRT. By so doing a desired image will be produced on the viewing area as the incident electrons excite photon emission from the phosphor.

Since the very small cross-sectional area electron beam is scanned over the entire active area of the CRT it dwells on a particular spot for only a very short period of time. In the instance of CRTs utilized in commercial television applications the dwell time is on the order of a few tens of nano-seconds. In order to operate CRTs with reasonable brightness levels for viewing it is necessary that during the short dwell time as many photons as possible be generated from the phosphor. Accordingly, electron beams of high current density are commonly employed to energize the phosphor. This results in operation of the phosphor in a saturation mode wherein additional electron excitation provides diminishing photon generation. A number of shortcomings may be attributed to this mode of operation which include reduced phosphor lifetime (phosphor lifetime is an inverse function of deposited charge), phosphor heating, poor resolution, and poor overall efficiency. Phosphor heating results from the increase in energy which must be dissipated in the viewing screen (faceplate) of the CRT as a result of increased electron current. Poor resolution occurs due to beam spreading which results from the increased current density electron beam. Efficiency degrades as a result of operating in a saturation mode wherein few activation centers remain to accept a transfer of energy from the incoming energetic electrons.

Alternatives to the CRT have been proposed which include devices such as back-lit liquid crystal displays, plasma displays, electroluminescent displays, and flat field-emission displays. All of these alternative techniques fail to provide superior brightness characteristics and resolution which are deemed essential for evolving display products.

Accordingly, there exists a need for a device, technology, or method which overcomes at least some of the shortcomings of the prior art.

SUMMARY OF THE INVENTION

These needs and others are substantially met through provision of a method for addressing an image display including the steps of providing an image display device comprised of, a viewing screen whereon a cathodoluminescent material is disposed and an array of field emission devices (FEDs) distally disposed with respect to the viewing screen and selectively independently operably connected each to at least some of a plurality of conductive paths, providing a plurality of controlled constant current sources each operably coupled between a conductive path of the plurality of conductive paths and a reference potential, providing a switching circuit having an input terminal and a plurality of output terminals wherein each of at least some of the plurality of output terminals is operably connected to one conductive path of the plurality of conductive paths, providing a first voltage source operably coupled between the switching circuit input terminal and the reference potential, and providing a second voltage source operably coupled between the viewing screen and the reference potential.

These needs are further met by providing an image display assembly comprising: an image display device including a viewing screen whereon a cathodoluminescent material is disposed and an array of field emission devices (FEDs) distally disposed with respect to the viewing screen and selectively independently operably connected each to at least some of a plurality of conductive paths, a plurality of controlled constant current sources each operably coupled between a conductive path of the plurality of conductive paths and a reference potential, a switching circuit having an input terminal and a plurality of output terminals wherein each of at least some of the plurality of output terminals is operably connected to one conductive path of the plurality of conductive paths, a first voltage source operably coupled between the switching circuit input terminal and the reference potential, and a second voltage source operably coupled between the viewing screen and the reference potential.

In a first embodiment of the invention the method is employed to provide row-by row addressing of an array of FEDs wherein each FED of an addressed row of FEDs will provide an emitted electron current substantially as determined by a controlled constant current source operably connected thereto and wherein selected portions of a cathodoluminescent material corresponding to individual display pixels will be controllably excited to emit photons in correspondence with the emitted electron current magnitude.

DETAILED DESCRIPTION OF THE PREFERRED EMBODIMENTS

Figure 4:
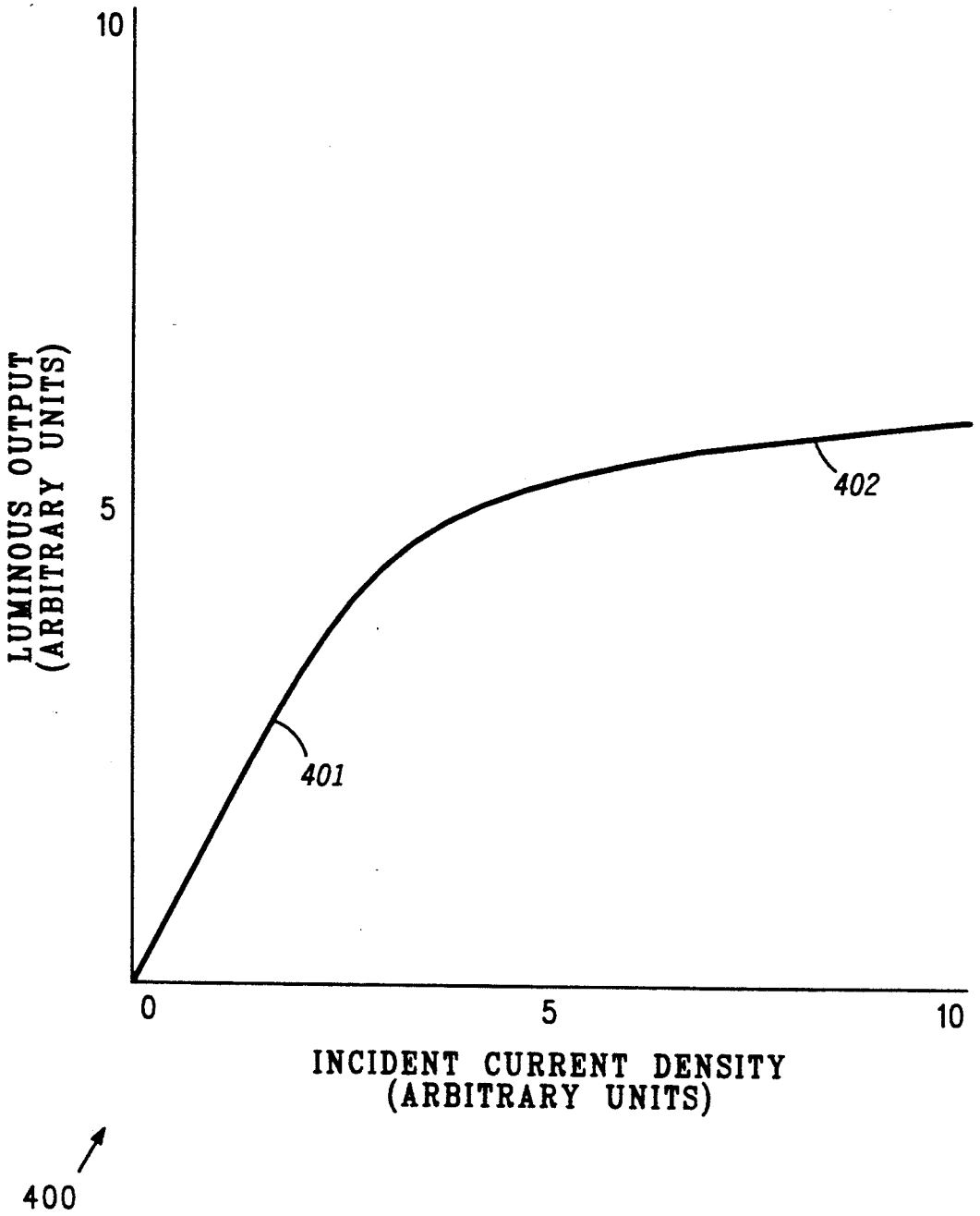
FIG. 4 is a graphical representation of the relationship between incident current density and luminous output for cathodoluminescent phosphors.

Cathodoluminescent materials (phosphors) are known to be excited to emit photons by impingement of energetic electrons; hence the name cathodoluminescent. FIG. 4 depicts a graphical representation 400 of a common response characteristic wherein luminous output of the phosphor is directly related to the current density of the incident energetic electrons. It is apparent from the illustration that as current density increases the corresponding increase in luminous output does not remain linear. For example, at a first point 401 on the characteristic curve for this arbitrary phosphor a unit increase in current density yields approximately a 1.5 unit increase in luminous output while at a second point 402 on the characteristic curve a unit increase in current density yields approximately a 0.2 unit increase in luminous output. Clearly, as incident current density is increased beyond a value, determined by the cathodoluminescent material and activation center constituents, the luminous output saturates. Beyond saturation additional increases in incident current density provides little increase in luminous output. Highest efficiency operation is achieved when phosphors are operated in the low current density non-saturated region. In the instance of prior art, cathodoluminescent image display operation was carried out in the poor efficiency saturated region in order to obtain maximum luminous output to the detriment of efficiency.

Average luminous output is a function of peak luminous output, excitation period, phosphor persistance, and the recurrence period of excitation. For phosphors driven to saturation small increases in excitation period will have little impact on average luminous output. This is primarily due to the fact that photon emission occurs when activation centers in the phosphor emit photons as part of a recombination process. For saturated phosphor such as that indicated by the second point 402, wherein substantially all activator centers are energized, additional stimulation in the form of extended excitation period will have substantially no effect until excited activation centers fall back to the un-excited state.

However, phosphors excited with incident current densities corresponding to un-saturated luminous output levels, such as that depicted by the first point 401, provide significantly greater average luminous output when excited for longer excitation periods per recurrence period. This is primarily due to the circumstance that un-saturated phosphors have substantial numbers of un-energized activator centers and the probability that additional incident electrons may energize such activation centers is large.

Figure 1:
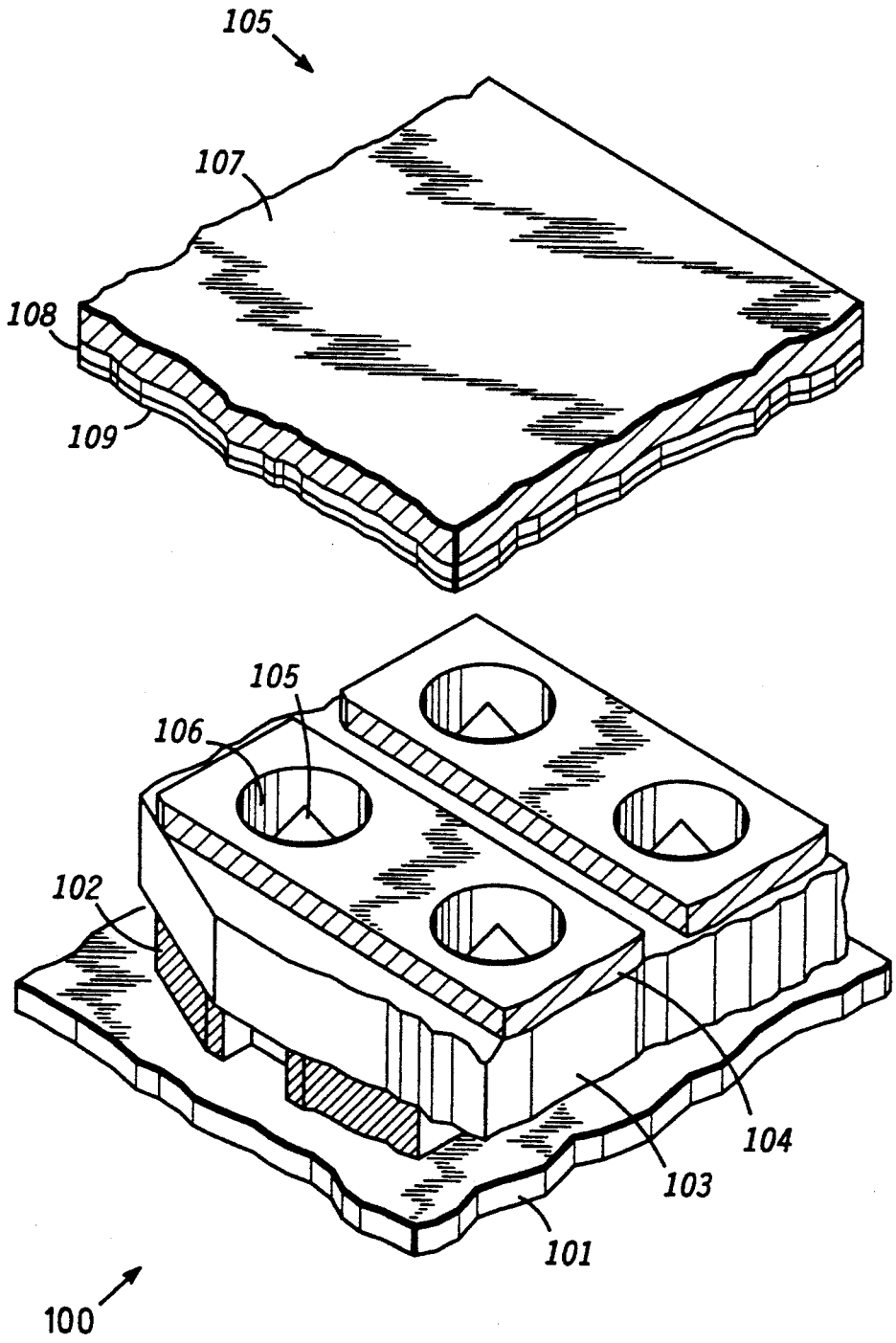
FIG. 1 is a partial perspective view of an embodiment of an image display device employing field emission device electron sources in accordance with the present invention.

FIG. 1 is a partial perspective view representation of an image display device 100 as configured in accordance with the present invention. A supporting substrate 101 has disposed thereon a first group of conductive paths 102. An insulator layer 103 having a plurality of apertures 106 formed therethrough is disposed on supporting substrate 101 and on the plurality of conductive paths 102. Apertures 106 have disposed therein electron emitters 105 which electron emitters 105 are further disposed on conductive paths 102. A second group of conductive paths 104 is disposed on insulating layer 103 and substantially peripherally about apertures 106. An anode 110, including a viewing screen 107 having disposed thereon a cathodoluminescent material 108, is distally disposed with respect to electron emitters 105. An optional conductive layer 109 is disposed on the cathodoluminescent material (phosphor) 108, as shown, or layer 109 may be positioned between the viewing screen 107 and the phosphor 108.

Each conductive path of the first group of conductive paths 102 is operably coupled to electron emitters 105 which are disposed thereon. So formed, electron emitters 105 associated with a conductive path of the first group of conductive paths 102 may be selectively enabled to emit electrons by providing an electron source operably connected to the conductive path.

Each conductive path of the second group of conductive paths 104 is disposed peripherally about selected apertures 106 in which electron emitters 105 are disposed. So formed, electron emitters 105 associated with a conductive path of the second group of conductive paths 104 is induced to emit electrons provided that the conductive path of the second group of conductive paths 104 is operably connected to a voltage source (not shown) to enable electron emission from the associated electron emitters 105 and the conductive path of the first group of conductive paths 102 to which electron emitters 105 are coupled is operably connected to an electron source (not shown).

Each aperture 106 together with the electron emitter 105 disposed therein and a conductive path of the first group of the plurality of conductive paths 102 on which the electron emitter 105 is disposed and to which the electron emitter 105 is operably coupled and an extraction electrode, including a conductive path of the second group of conductive paths 104 peripherally disposed thereabout, comprises a field emission device (FED). While the structure of FIG. 1 depicts an array of four FEDs, it should be understood that arrays of FEDs may comprise many millions of FEDs.

Selectively applying a voltage to an extraction electrode of an FED and selectively operably connecting an electron source to a conductive path operably coupled to electron emitter 105 of the FED will result in electrons being emitted into a region between electron emitter 105 and distally disposed anode 110. Electrons emitted into this region traverse the region to strike anode 110 provided a voltage (not shown) is applied to anode 110. Emitted electrons which strike anode 110 transfer energy to phosphor 108 and induce photon emission. Selectively enabling FEDs of the array of FEDs provides for selected electron emission from each of the enabled FEDs to corresponding regions of anode 110. Each FED or, as desired, group of FEDs of the array of FEDs provides electrons to a determinate portion of phosphor 108. Such a determined portion of phosphor 108 is termed a picture element (pixel) and is the smallest area of the viewing screen which can be selectively controlled.

Figure 2:
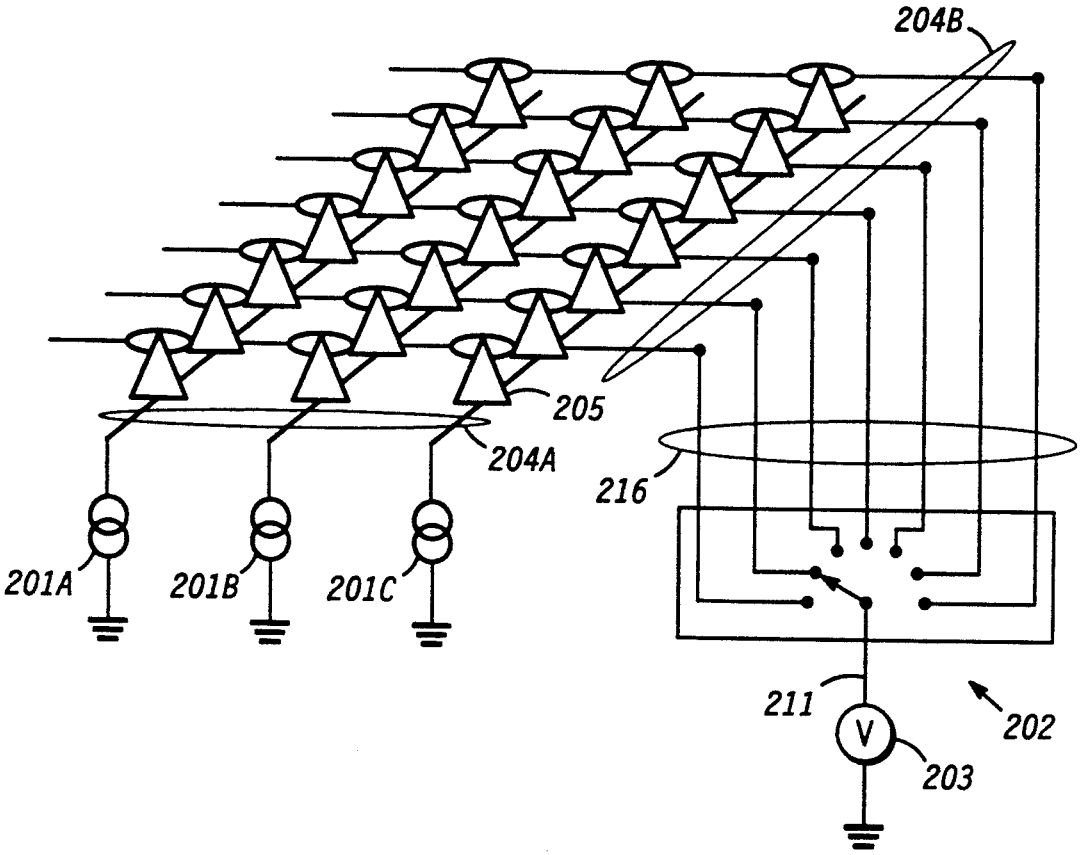
FIG. 2 is a schematic representation of an image display employing an addressing method in accordance with the present invention.

FIG. 2 is a schematic representation of an array of FEDs wherein extraction electrodes 204B correspond to a first group of conductive paths and emitter conductive paths 204A correspond to a second group of conductive paths. In this embodiment, first and second groups of conductive paths 204B and 204A, respectively, make up a plurality of conductive paths. Appropriately energized, as described previously with reference to the FEDs of FIG. 1, the FEDs selectively emit electrons. In the schematic depiction of FIG. 2 a controlled constant current source 201A–201C is operably connected between each of the second group of conductive paths 204A and a reference potential, such as ground, to provide a determinate source of electrons to electron emitters 205 operably coupled thereto. Each extraction electrode 204B is operably coupled to one output terminal of a plurality of output terminals 216 of a switching circuit 202. A voltage source 203 is operably connected between an input terminal 211 of switching circuit 202 and a reference potential, such as ground.

By selectively controlling the desired level of electrons provided by controlled constant current sources 201A-201C and by selectively switching voltage source 203 to a selected output terminal of the plurality of output terminals 216, a row of FEDs is simultaneously energized and the electron emission from each FED of the row is determined. By providing that switching circuit 202 connects voltage source 203 to a single extraction electrode in a single row of FEDs the electron current prescribed by controlled constant current source 201A-201C is emitted, substantially in total, by those FEDs associated with the row and particular column. Each pixel of the viewing screen (not shown) corresponding to the FEDs of the selected row of FEDs is energized according to the emitted electron current density prescribed by the controlled constant current source 201A-201C operably coupled thereto.

Switching circuit 202 is realized by any of many means known in the art such as, for example, mechanical and electronic switching. In some anticipated applications it will be desired that the switching function realized by the switching circuit will be cyclic (periodic recurring) and sequential. Such a switching function, when applied to an image display employing an array of FEDs as described herein, provides for row-by-row addressing of viewing screen pixels.

Figure 3:
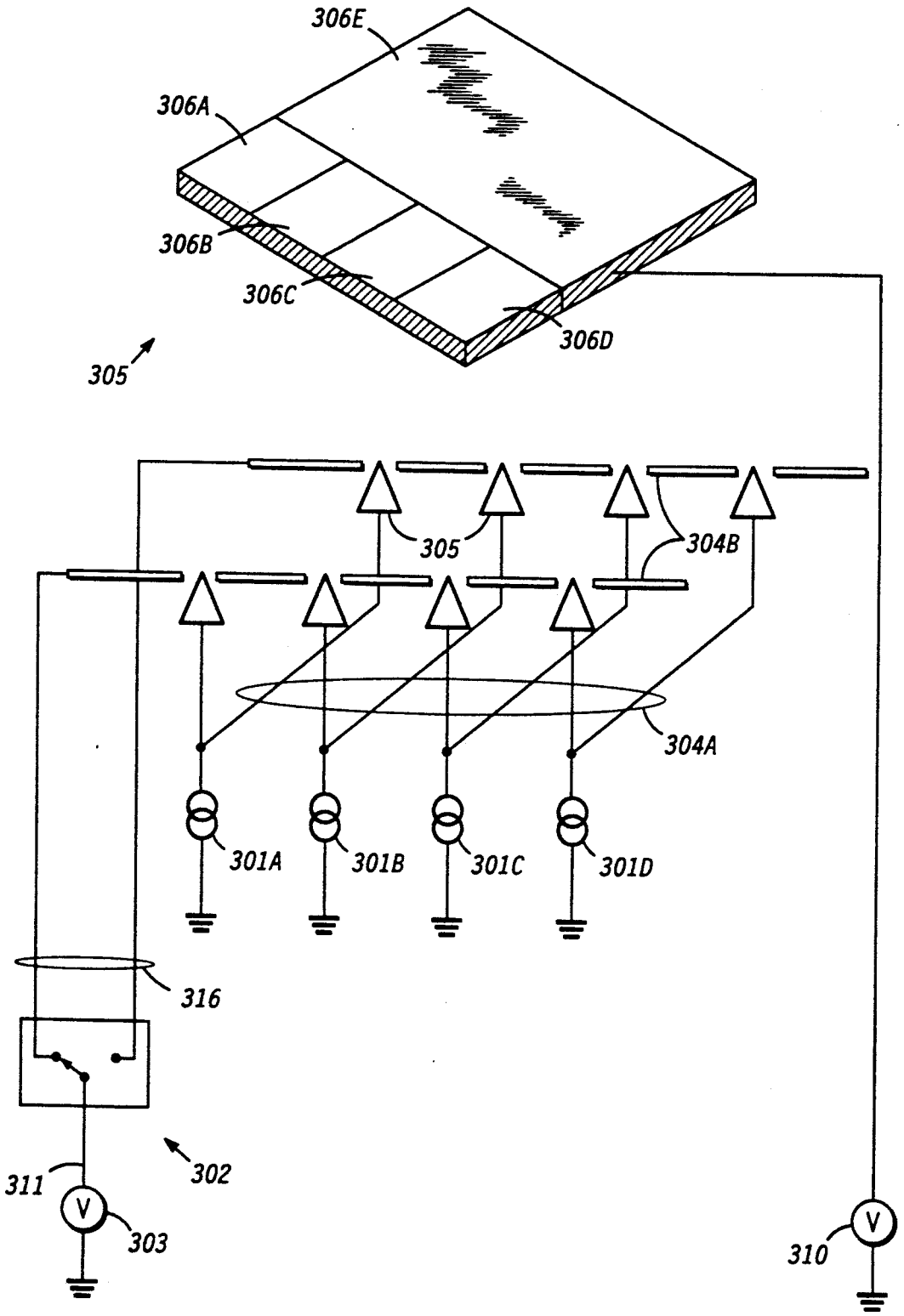
FIG. 3 is a schematic representation of an image display employing an addressing method in accordance with the present invention.

FIG. 3 is a schematic representation of an image display 300 employing an array of FEDs as electron sources and including a plurality of controlled constant current sources 301A-301D, a switching circuit 302, a first voltage source 303, and a second voltage source 310, and depicting a method for addressing image display 300. As described previously with reference to FIG. 2 the switching circuit includes a plurality of output terminals 316 and an input terminal 311. Controlled constant current sources 301A-301D are each operably connected between a conductive path of a second group of conductive paths 304A and a reference potential. Each output terminal of the plurality of output terminals 316 is operably connected to an extraction electrode of a plurality of extraction electrodes 304B which include a first group of conductive paths. (In FIG. 3 the extraction electrode associated with each row of FEDs of the array of FEDs is depicted as a plurality of line segments. Such a depiction of an extraction electrode, common to a plurality of FEDs, is generally accepted practice and does not imply that the physical embodiment of such an extraction electrode will be physically segmented.) First voltage source 303 is operably connected between input terminal 311 of switching circuit 302 and a reference potential. A second voltage source 310 is operably connected between an image display viewing screen 305 and a reference potential.

Viewing screen 305 depicts that distinct regions of viewing screen 305 corresponding to a row of pixels 306A-306D are selectively energized such that each pixel of the row may be induced to provide a desired level of luminous output (pixel brightness). This selective energizing of viewing screen pixels is realized by prescribing that each controlled constant current source 301A-301D provides a determinate source of electron current to be emitted at the same time switching circuit 302 switches first voltage source 303 to the extraction electrode corresponding to the row of FEDs and the corresponding row of pixels 306A-306D desired to be energized. Viewing screen 305 depicts that all rows of pixels 306E, corresponding to rows of FEDs not selected by switching circuit 302, are un-energized.

By selectively providing a controlled constant current to the electron emitters of FEDs associated with each pixel of a row of pixels a full row of pixels is simultaneously energized (placed in an ON mode). As switching circuit 302 switches to operably couple first voltage source 303 to some other one of the plurality of extraction electrodes 304B the desired electron current, corresponding to the desired luminous output of each pixel of the newly selected row of pixels, made available to the electron emitters of the FEDs associated with the newly selected row of FEDs, is provided by exercising control of each constant current source 301A-301D. (For the purposes of this disclosure a controlled constant current source implies that, as prescribed by the controlling mechanism, the current sourced will be constant. However, the controlling mechanism associated with each of the controlled constant current sources 301A-301D may prescribe different constant currents.)

In one embodiment of the row addressing method described, the rows of pixels comprising the viewing screen are sequentially cyclically energized. Since each pixel of a row is energized simultaneously, each pixel is energized for the entire period during which the row is selected. As such the excitation period of each pixel is increased as a multiple of the number of pixels per row. For example, a particular embodiment of an image display may employ 1200 pixels per row. For such an image display each pixel in a row may be energized for an excitation period 1200 times longer than is possible when scanning techniques are employed. The pixel excitation period for a typical scanned image display is approximately 20 nano-seconds. The pixel excitation period for a comparable row-by-row addressing method is approximately 20 micro-seconds. Each row will be scanned at a cyclic rate of 60 cycles per second which corresponds to each pixel being energized for approximately 1 milli-second during each second of display operation in contrast to an excitation of approximately 1 micro-second per pixel for scanned excitation. By providing for such a significant increase in the excitation period of each pixel the incident current density required to achieve an equivalent (with respect to scanning) average luminous output is reduced. This addressing method, therefore, provides for improved efficiency as the incident current density is shifted to the non-saturated region of the characteristic curve as described previously with reference to FIG. 4.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What we claim is:

1. A method for addressing an image display comprising the steps of:

providing an image display device including a viewing screen whereon a cathodoluminescent material is disposed and an array of field emission devices distally disposed with respect to the viewing screen and further providing a plurality of conductive paths separated into a plurality of conductive paths in rows and a plurality of conductive paths in columns with each field emission device being selectively independently operably connected to one of the conductive paths separated into rows and one of the conductive paths separated into columns so that a plurality of the array of field emission devices is connected in each row and a plurality of the array of field emission devices is connected in each column;

providing a plurality of controlled constant current sources each operably coupled between a conductive path of the plurality of conductive paths in columns and a reference potential;

providing a switching circuit having an input terminal and a plurality of output terminals wherein each of the plurality of output terminals is operably connected to a different conductive path of the plurality of conductive paths in rows;

providing a first voltage source operably coupled between the switching circuit input terminal and the reference potential and the switching circuit functions to operably connect the first voltage source to one selected conductive path of the plurality of conductive paths in rows at a given time;

providing a second voltage source operably coupled between the viewing screen and the reference potential; and switching the switching circuit and controlling the constant current sources so that substantially all of the plurality of field emission devices connected in a selected conductive path of the plurality of conductive paths in rows are selectively simultaneously placed in an ON mode and each of the plurality of field emission devices connected in a selected conductive path of the plurality of conductive paths in rows emits an electron current substantially determined by a controlled constant current source of the plurality of controlled constant current sources.

2. A method as claimed in claim 1 wherein the conductive path is electronically selected.

3. A method as claimed in claim 2 wherein electronic selection is sequential and cyclic.

4. A method as claimed in claim 3 wherein the cycle is determined to provide that each selected conductive path is operably connected to the first voltage source for approximately 20 micro-seconds during each cycle.

5. A method as claimed in claim 4 wherein the cycle provides that each conductive path operably coupled to the switching circuit is operably connected to the first voltage source on the order of 1 milli-second per second.

6. A method as claimed in claim 2 wherein the selected conductive path is operably coupled to an extraction electrode of field emission devices of the array of field emission devices which comprise a row of field emission devices.

7. A method as claimed in claim 6 wherein each field emission device of the row of field emission devices also operably coupled to the one controlled constant current source of the plurality of controlled constant current sources comprises a pixel electron source to energize a viewing screen pixel.

8. A method as claimed in claim 7 wherein each of the plurality of controlled constant current sources provides a determinate current of electrons corresponding to a desired viewing screen pixel brightness.

9. A method as claimed in claim 8 wherein a row of viewing screen pixels corresponding to a row of pixel electron sources are simultaneously selectively energized.

10. A method as claimed in claim 9 wherein sequentially energized rows of viewing screen pixels provides row by row image display addressing.

* * * * *